US007338340B2

(12) United States Patent
Poesch

(10) Patent No.: US 7,338,340 B2
(45) Date of Patent: Mar. 4, 2008

(54) TOY FIGURE WITH INTERCHANGEABLE BRAIN HAVING ASSOCIATED VOICE RESPONSES

(75) Inventor: Eric S. Poesch, Thousand Oaks, CA (US)

(73) Assignee: Uncle Milton Industries, Inc., Westlake Village, CA (US)

( * ) Notice: Subject to any disclaimer, the term of this patent is extended or adjusted under 35 U.S.C. 154(b) by 281 days.

(21) Appl. No.: 11/089,255

(22) Filed: Mar. 24, 2005

(65) Prior Publication Data

US 2005/0215170 A1 Sep. 29, 2005

Related U.S. Application Data

(60) Provisional application No. 60/556,036, filed on Mar. 24, 2004.

(51) Int. Cl.
*A63H 3/16* (2006.01)
*A63H 3/28* (2006.01)

(52) U.S. Cl. ..... 446/297; 446/100

(58) Field of Classification Search ..... 446/100, 446/297, 318, 321, 484
See application file for complete search history.

(56) References Cited

U.S. PATENT DOCUMENTS 4,869,701 A 9/1989 Kawai et al.
5,073,140 A * 12/1991 Lebensfeld et al. ..... 446/297
5,607,336 A * 3/1997 Lebensfeld et al. ..... 446/297

(Continued)

FOREIGN PATENT DOCUMENTS

EP 0 606 790 A2 7/1994

(Continued)

OTHER PUBLICATIONS

International Search Report, PCT/US2005/009685, Sep. 8, 2005.

(Continued)

*Primary Examiner*—Eugene Kim
*Assistant Examiner*—Alyssa M Hylinski
(74) *Attorney, Agent, or Firm*—Frost Brown Todd LLC

(57) ABSTRACT

A set of toy figures each has a main body portion and a detachable brain portion that are associated with a certain archetype (e.g., policeman, skateboarder, soldier, infant, athlete, cheerleader, pirate, princess, etc). In response to a user engaging a brain portion and depressing the squishy brain, a switch activates a voice response circuit that plays a voice script stored on a main PCB assembly in the brain portion with a tonal quality associated with the archetype for the main body portion. Thus, if a brain portion matched with another archetype is attached, the assembled toy figure will say content that is not associated with the toy figure but in a manner that is appropriate. Thus, a soldier's brain would speak soldier jargon, but in an infantile way when on an infant body, providing increased variety and amusement possibilities for a set of such toy figures.

19 Claims, 4 Drawing Sheets

U.S. PATENT DOCUMENTS

| | | | | |
|---|---|---|---|---|
| 5,788,554 | A | 8/1998 | Goodwin et al. | |
| D411,596 | S | 6/1999 | Mass et al. | |
| 6,159,017 | A * | 12/2000 | Coomansingh | 434/267 |
| 6,200,188 | B1 | 3/2001 | Filo | |
| 6,236,305 | B1 * | 5/2001 | Martin | 340/384.3 |
| 6,257,948 | B1 * | 7/2001 | Silva | 446/100 |
| 6,435,936 | B1 | 8/2002 | Rehkemper et al. | |
| 6,447,359 | B1 * | 9/2002 | Crump | 446/100 |
| 6,514,118 | B1 | 2/2003 | Bart et al. | |
| 6,524,159 | B1 * | 2/2003 | Kawarizadeh | 446/397 |
| 6,554,679 | B1 * | 4/2003 | Shackelford et al. | 446/268 |
| 6,648,719 | B2 * | 11/2003 | Chan | 446/297 |
| 6,648,725 | B2 | 11/2003 | Chan | |
| 6,719,604 | B2 * | 4/2004 | Chan | 446/297 |
| 2002/0086612 | A1 * | 7/2002 | Chan | 446/479 |

FOREIGN PATENT DOCUMENTS

| | | |
|---|---|---|
| WO | WO 00/23161 | 4/2000 |

OTHER PUBLICATIONS

Durolatex Models of Human Anatomy; Chicago Apparatus Company; Chicago, IL. (1939) pp. 1-5.

* cited by examiner

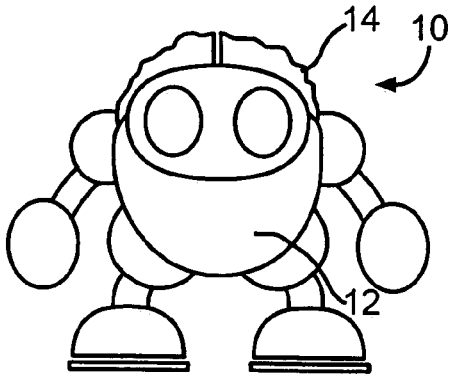
FIG. 3
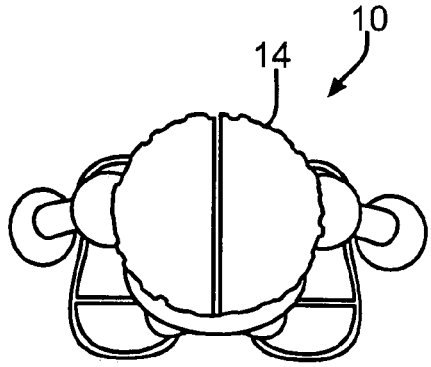
FIG. 4
FIG. 5
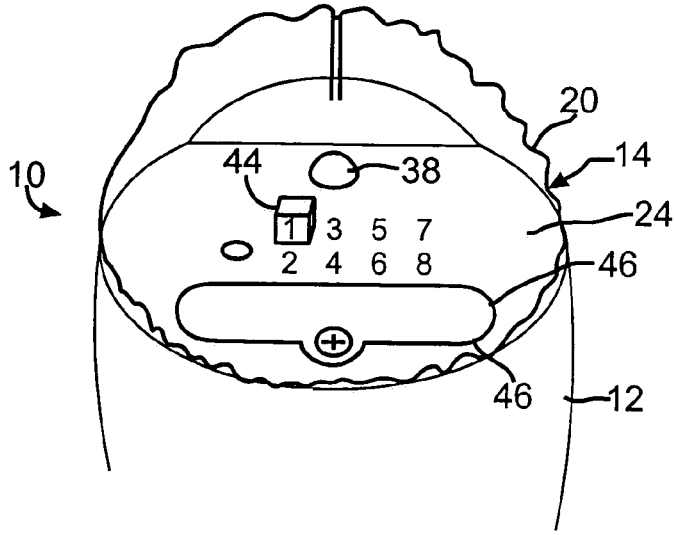
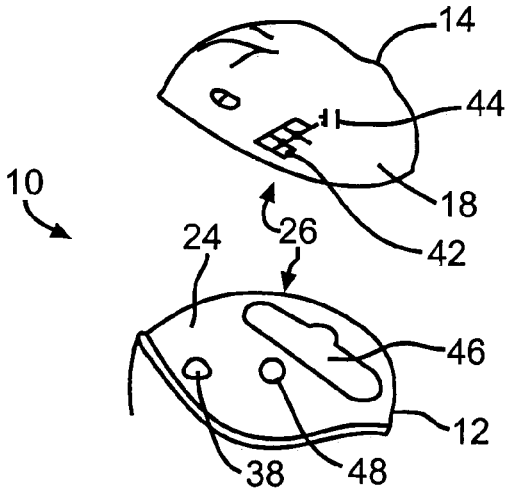
FIG. 6

TOY FIGURE WITH INTERCHANGEABLE BRAIN HAVING ASSOCIATED VOICE RESPONSES

CROSS REFERENCE TO RELATED APPLICATIONS

The present invention claims the benefit of U.S. provisional patent application of the same title, Ser. No. 60/556,036, filed 24 Mar. 2004.

FIELD OF THE INVENTION

The present invention relates, in general, to toys that respond to user activation with one of a plurality of recorded statements, and more particularly, to a set of toy figurines having the personality of the recorded statements responsive to insertion of a detachable body portion.

BACKGROUND OF THE INVENTION

Toy figures that respond with a prerecorded script have been a popular favorite for many decades. Recently, with increasingly capable and economical voice synthesizing integrated circuits, more and more toys include a realistic voice or sound effect that corresponds to the type of toy. However, the amusement of playing back the recorded messages soon wanes after hearing each possible script a number of times.

Consequently, a significant need exists for a toy figure that has a wider range of possibilities than playing one of a set of voice scripts.

BRIEF SUMMARY OF THE INVENTION

The invention overcomes the above-noted and other deficiencies of the prior art by providing a set of toy figures, each styled for a recognizable archetype (e.g., athlete, soldier, policeman, teacher, infant). Each has a set of voice responses that would be typically associated with the archetype in content and tonal quality. Each toy figure also includes a detachable body portion (e.g., resilient brain) that may be interchangeably received by another toy figure. The toy figure responds to the insertion of a brain from another archetype toy figure by playing the set of voice responses (word content) that goes with the detachable body portion but with the tonal quality (e.g., accent, pitch) that goes with a main body portion of the toy figure, providing more amusing possibilities rather than a single set of voice responses.

These and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

FIG. 3 is a front view in elevation of the toy figure of FIG. 1.

FIG. 4 is a top view of the toy figure of FIG. 1.

FIG. 5 is a perspective view of a top portion of the toy figure of FIG. 1 with a personalized brain portion shown in phantom to expose a personality interface.

FIG. 6 is a perspective view of the top portion of the toy figure of FIG. 5 with the personalized brain portion detached.

DETAILED DESCRIPTION OF THE INVENTION

Figure 1:
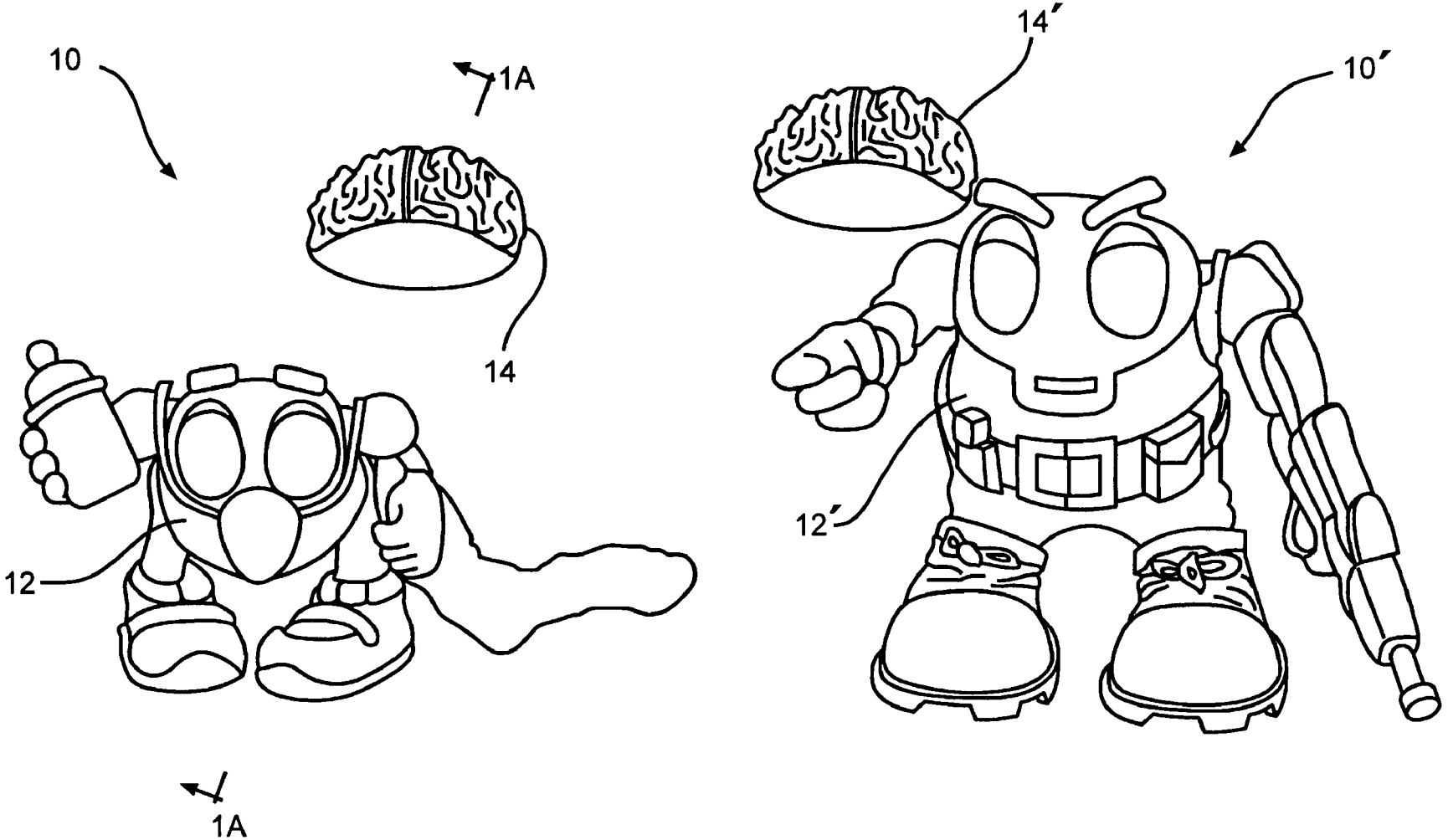
FIG. 1 is a front perspective view of a toy set having a plurality of toy figures assembled by the user from differentiated body components and associated but interchangeable, color-coded brain components.
Figure 1A:
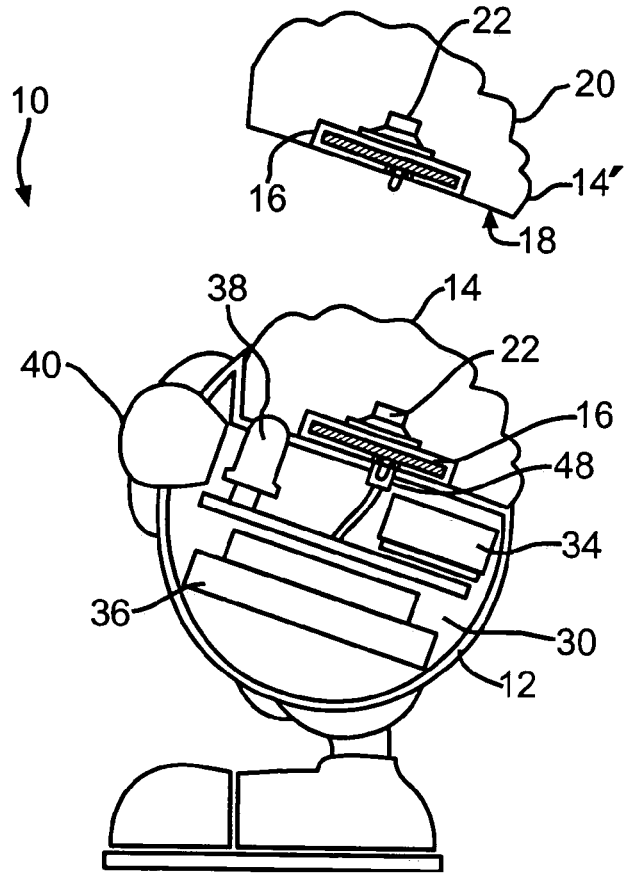
FIG. 1A is a left side elevation view in cross section taken along lines 1A-1A of the toy figure of FIG. 1 with a detachable, interchangeable brain and alterable voice circuitry.

Turning to the Drawings wherein like numerals denote like components throughout the several views, in FIGS. 1, 1A, a plurality of toy FIGS. 10, 10' are assembled by the user from differentiated main body portion 12, 12' and associated but interchangeable, color-coded brain portions 14, 14'.

With particular reference to FIG. 1A, the main body portion 12 may be aesthetically styled to correspond to an archetype (e.g., policeman, skateboarder, soldier, infant, athlete, cheerleader, pirate, princess, etc.) with a detachable body part, depicted as an interchangeable brain portion 14. One brain portion 14 that is matched to the main body portion 12 is attached thereto and a second brain portion 14' that is mismatched to the main body portion 12 is shown detached, but is form fit and interchangeable with the matched brain portion 14. The mismatched brain portion 14' comes from another toy FIG. 10' that is styled for another archetype. Each brain portion 14, 14' may include a distinguishing characteristic to help associate them with the matching main body portion 12, 12' (e.g., color, printed text, stylized hat).

The brain portion 14 includes a main printed circuit board (PCB) assembly 16 attached to a bottom surface 18 of a brain-shaped block 20 formed from a translucent, resilient (squishy) polymer. The main PCB assembly 16 includes a switch 22 that is encompassed by the brain-shaped block 20.

The main body portion 12 presents an upper surface 24 shaped to engage the brain portion 14. In particular, a personality interface 26 is formed between the brain portion 14 and the main body portion 12 at the personality interface 26. A voice response circuit 30 contained in the toy FIG. 10 produces one of a series of voice scripts appropriate for the matched configuration of the main body portion 12 and the matched brain portion 14. The voice response circuit 30 produces an altered series of voice scripts in response to the main body portion 12 being paired with the mismatched brain portion 14'.

Figure 2:
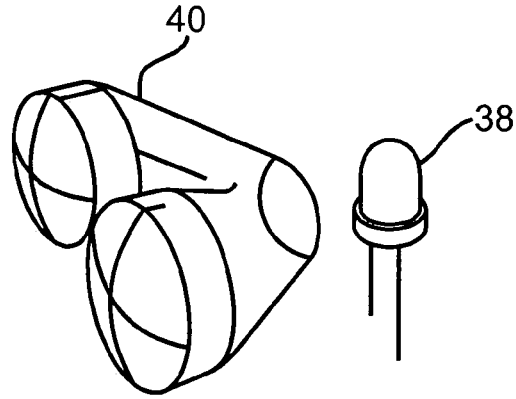
FIG. 2 is a perspective detail view of eye tubes and a light element of the toy figure of FIG. 1.

In the illustrative version, a set of voice scripts (content) are stored in a recording medium on the main PCB assembly 16 in the brain portion 14, 14', this content having statements that are associated with the matched archetype. A secondary PCB assembly 32 in the main body portion 12 reads one of these voice scripts from the main PCB assembly 16 in response to a user activating the switch 22 and plays it with a tonal quality (e.g., voice, accent) associated with the archetype for the main body portion 12. The main body portion includes batteries 34 (e.g., two AG13 batteries) and a speaker 36 for making these sounds, and in addition includes a light (e.g., Light Emitting Diode (LED)) 38 positioned partly exposed through the upper surface 24. With particular reference to FIGS. 1-2, eye tubes 40 of the main body portion 12 are illuminated by the LED 38, the latter also illuminating brain-shaped block 20.

With particular reference to FIGS. 5-6, the personality interface 26 includes a body identification matrix 42 formed in the upper surface 24 of the main body portion 12 that has a plurality of receptacles for sensing the position of a brain type identifier, depicted as a downwardly projecting pin 44. A battery door 46 formed in the upper surface 24 provides a convenient location for accessing the batteries 34. An electrical connect for forming a voice integrated circuit (IC) connection 48 is formed across the personality interface 26 to communicate the word content stored on the main PCB assembly 16 to the secondary PCB assembly 32.

Alternatively, the brain portion 14 may present electrical contacts or a magnetic element or target or a unique RF emitting target that allow for identification of the associated archetype for the brain portion 14.

Figure 7:
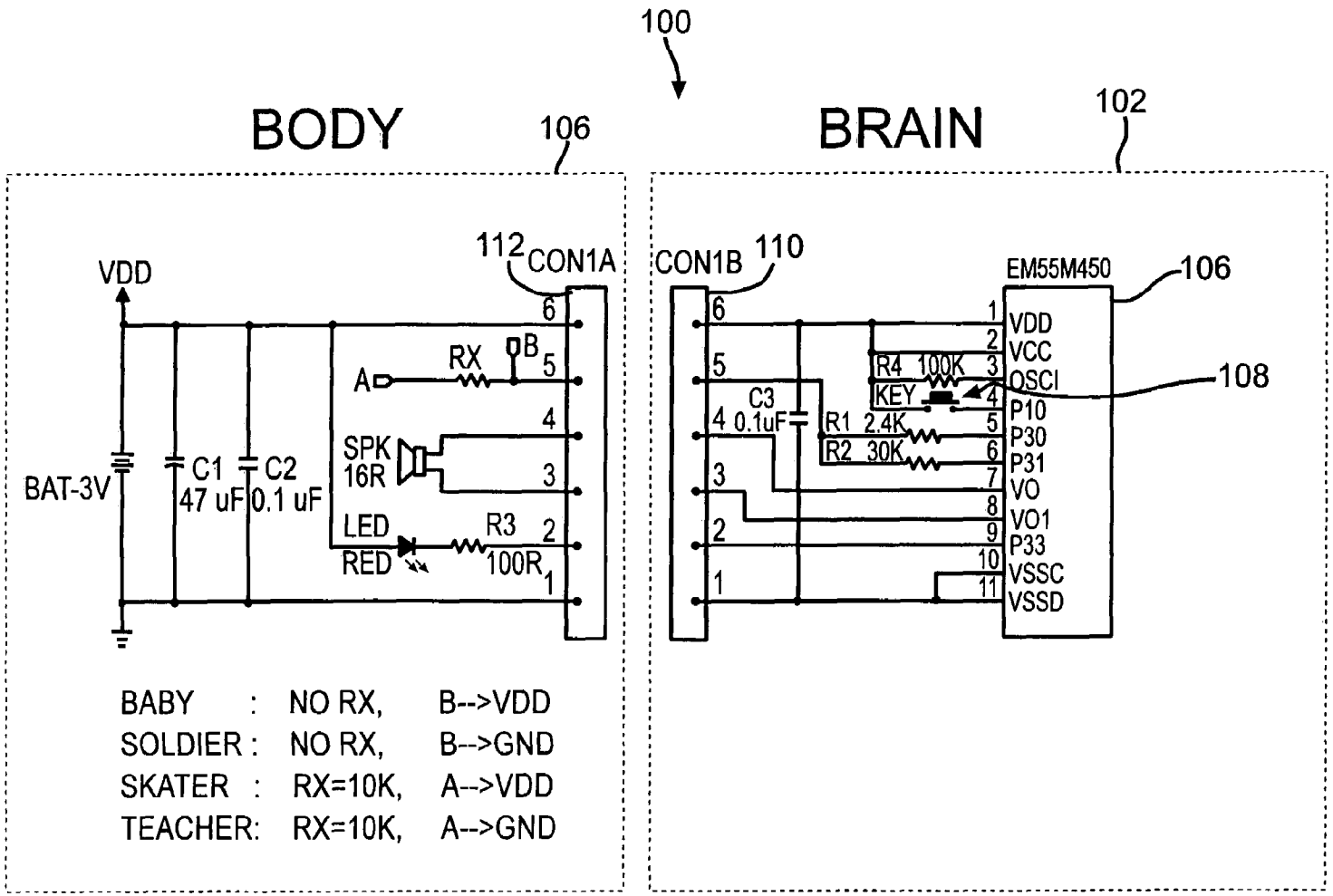
FIG. 7 is a circuit diagram of a tiny controller-based voice synthesizer of the toy figure of FIG. 1A.

In FIG. 7, illustrative circuitry 100 for the toy FIG. 10 is depicted wherein brain circuitry 102 is built upon a tiny controller-based synthesizer integrated circuit (IC) 104, such as part number EM55M450 by Elan Microelectronics Corporation, Hsinchu Science Industrial Park, Taiwan. This version incorporates a 63 second single chip high quality voice synthesizer IC which contains one 4-bit Input port, three 4-bit I/O ports and a tiny controller. By programming through the tiny controller, user's application includes section combination, trigger mode, control outputs, keyboard matrix and other logic functions. The synthesizer IC 104 is programmed for a pulse width modulated (PWM) voice output circuit wherein each configuration of brain circuitry 102 has four sets of phrases. Each set of phrases corresponds with one of possible body circuitry 106 in the series, and can only be activated when it is inserted into that main body portion 12. Resistance value mapping method is used to identify the different characters. Each character has been assigned a specific resistor value for identification. When the brain portion 14 is plugged into the main body portion 12, the synthesizer IC 104 checks the value of the resistor RX in the body circuitry 106 to determine which body is connected. After the type of body circuitry 106 is determined, the synthesizer IC 104 identifies which of the phrase sets will be used when the user activates the unit by pressing a button 108 located on the brain portion 14. The button 108 connects pin 4 (P10) of the synthesizer IC 104 to pin 6 of a brain circuit connector 110 that connects to pin 6 of a corresponding body circuit connector 112 of the body circuitry 106, which in turn is coupled to a direct current power supply voltage VDD. The RX value of the body circuitry 106 varied by configuring a connector pin 5 of body connector 112 in one of four ways. For baby type, pin 5 is connected to VDD. For soldier type, pin 5 is connected to circuit ground GND. For skater type, the VDD is connected via a 10 k Ohm resistor to pin 5. For teacher type, circuit ground GND is connected via a 10 k Ohm resistor to pin 5. The corresponding pin 5 of the brain circuit connector 110 is connected via an R1 resistor of 2.4 k Ohm to pin 5 (P30) of the synthesizer IC 104 and via an R2 30 k Ohm resistor to pin 6 (P31) of the synthesizer IC 104.

It should be appreciated that an alternate Resistance Mapping Method may entail utilizing an analog-to-digital converter (ADC) IC to measure the voltage drop across the resistor RX. Then the measured voltage is converted to a resistor value by proportion if the current flowing through is kept constant. As another example, a mechanical method may include incorporating into the brain portion a plastic "finger" that correspond to one of four buttons built into the P-Brain body. Each of the four brains in the series activates a different button on the body. Each button signals the PWM voice output circuit to play only one of the sets of phrases. As yet another example, a dual IC method may comprise an IC controller built into both the body and brain portions. When a brain is inserted into a body, the two IC controllers communicate to determine which body is connected, and which phrase set should be activated.

The remaining power biasing of the circuitry 100 includes a 3V battery 114 connected between pin 6 (+) and pin 1 (GND) of the body circuit connector 112. Coupled in parallel for noise reduction are a C1 capacitor of 47 μF and a C2 capacitor of 0.1 μF.

In the brain circuit connector 110, the VDD power is received by pin 6 and the electrical power (GND) is received by pin 1, with a C3 capacitor of 0.1 μF connected across pins 6 and 1 for noise reduction. Pin 6 is in turn connected to pin 1 (VDD), pin 2 (VCC) and via R4 resistor of 100 k Ohm to pin 3 osccillator (OSCI), all of the synthesizer IC 104. The pin 1 connects to pin 10 (VSSC) and pin 11 (VSSD) of the synthesizer IC 104. The PWM voice output circuit comprises a 16 R speaker in the body circuitry 106 that connects across pins 3 and 4 of the body circuit connector 112. Corresponding pins 3 and 4 of the brain circuit connector 110 in turn connect to pins 7 (VO) and 8 (VO1) of the synthesizer IC 104. An LED light circuit comprises a red LED in the body circuitry 106 connected between VDD of pin 6 and connected via a resistor R3 of 100 Ohms to pin 2 of the body circuit connector 112. Corresponding pin 2 of the brain circuit connector 110 connects to pin 9 (P33) of the synthesizer IC 104.

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art. For example, other body portions may be exchanged, such as an entire head rather than just a brain portion. As another example, all of the possible vocal scripts may be stored in a main body portion with a brain portion providing a passive identifier that the voice response circuit interprets for selecting the appropriate subset of scripts. As another example, all of the active components may be in the detachable portion with the main body being identified by the brain portion. As yet another example, although human archetypes are mentioned, the range of scripts may include animal and inanimate objects (e.g., a cow brain that moos with a duck accent when placed in a duck body, a robot and a human).

It should be appreciated with the benefit of the present disclosure that brain circuitry 102, in addition to containing audio phrases on the synthesizer IC 104, may also contain other personality data to control and alter the function of the product to further convey the personality of the character. Personality may manifest itself through function, movement, voice and sound effects, music and colored lights. Some examples are as follows. For example, a personality controlled vehicle may be used as an alternative to, or in addition to, a main body portion 102. A toy vehicle would require a character's brain to function. Insert the brain into the connecting port and the toy is operational. The vehicle would drive and operate in a manner consistent with the personality of the brain. For instance, the baby brain may cause the vehicle to drive in circles, stop, start, or in a random meandering manner (not knowing how to drive) while the soldier brain may cause the vehicle to drive in a manner resembling marching (forward march, left face, right face, double time, about face). The skater may make curving turns and wheelies whereas the cheerleader does staccato movements simulating a cheer.

The vehicle may advantageously incorporate sound effects that similarly adapt to the combination of the archetype of a brain portion with the archetype of the vehicle. For example, a military vehicle associated with the soldier may have a tonal quality of a growling engine and noisy treads as its archetype. The baby brain may cause occasional baby rattle sounds, or crib mobile tunes to be superimposed over the engine sound effect. As another example, an ice cream truck associated with the baby may occasionally burst into sound effects of weapons firing.

As another example, a personality directed musical instrument may be used as an alternative to, or in addition to, the main body portion 102. A toy musical instrument would require a character's brain to function. Inserting the brain into the connecting port allows the toy to operate. The musical instrument would play music in a manner consistent with the personality of the brain, i.e., the baby brain may cause the instrument to play a nursery melody while the soldier brain may cause the instrument to play a military march.

As yet an another alternative of, or an addition to a main body portion 102, a Link Lab may allow any one character of one series to switch brains with another character of any other series, i.e., all brains would be switchable with all characters in all series. In one version, this may entail building a very high capacity voice chip with sufficient storage capability into each character that would contain all data for all characters. This would have the benefit of being a simple solution for the consumer. The play pattern is no different and there are no additional components required since all the data is built into the characters. With increasing capabilities in ICs, this capability may even be or become economically feasible in the toy market.

In another version, a single connecting product ("Link Lab") is comprised of a main base unit that has two character pedestals. Character data (phrases) for "brain switching" is stored on and delivered through series specific "link chips" that are inserted into the base. Thus, any two characters are placed each on their own pedestal. For this example, we will use a series 1 character and a series 7 character. Once the characters have been placed on the base pedestals, two character ID readers (to identify to the internal IC within the Link Lab in which two characters have been placed on the base pedestals) are connected to the characters via their brain connecting port (in place of the brain) and the switched brains are then placed in top of the ID readers (the switched brains are not connected and therefore are non-operational, it is only to maintain the illusion that the brain is still functional and serving the purpose of delivering the voice phrases). To "switch the brains," a number of series specific "Link Chips" are required. In this case, a Series 1/7 link chip would be inserted into the base. The data (switched brain phrases) from the link chip is transferred through the internal Link Lab IC to the characters respectively and the speech is heard through the character's internal speaker. This version has the benefit of perhaps a more economical cost for each individual character with an optional expenditure to add switching brain functionality amongst all series.

In yet another "Mystery brain" version, separate brains may be sold individually or in triple packs. Character/brain personality is unknown until the brain is placed in a specific series character to deliver phrases/personality.

In yet a further version, a bonus brain may accompany each character. This is similar to Mystery Brain's description except for the manner in which it is purchased by the consumer.

What is claimed is:

1. A toy assembly, comprising:

(a) a first main body portion comprising arms, legs, and a torso, wherein the first main body portion is associated with a first archetype, wherein the first archetype is associated with a first voice script and a first voice tonal quality;

(b) a second main body portion comprising arms, legs, and a torso, wherein the second main body portion is associated with a second archetype, wherein the second archetype is associated with a second voice script and a second voice tonal quality;

(c) a first detachable body portion, wherein the first detachable body portion is associated with the first archetype; and (d) a second detachable body portion, wherein the second detachable body portion is associated with the second archetype;

wherein the first main body portion is configured to interchangeably receive a selected one of the first and second detachable body portions to form an assembled toy figure;

wherein the assembled toy figure comprises a first voice circuit when the first detachable body portion is coupled with the first main body portion, wherein the first voice circuit is configured to play a the first voice script with the first voice tonal quality;

wherein the assembled toy figure comprises a second voice circuit when the second detachable body portion is coupled with the first main body portion, wherein the second voice circuit is configured to play the second voice script with the first voice tonal quality.

2. The toy assembly of claim 1, wherein each of the first and second detachable body portions comprises a brain-shaped block.

3. The toy assembly of claim 1, wherein a selected one of the main body portion and the detachable body portion contains a synthesizer circuit and the other one of the main body portion and the detachable body portion contains an archetype identifier, the synthesizer circuit operably configured to detect the archetype identifier and to access archetype data associated with the archetype identifier.

4. The toy assembly of claim 3, wherein the archetype identifier comprises a selected one of a plurality of voltage resistance mapping values.

5. The toy assembly of claim 3, wherein the archetype identifier comprises a resistance value, the synthesizer configured to convert an analog to a digital voltage signal of a constant current value through the resistance value.

6. The toy assembly of claim 3, wherein the archetype identifier comprises a switch array uniquely activated by a mechanical interface corresponding to the archetype.

7. The toy assembly of claim 1, further comprising a memory element containing at least one set of archetype data, the memory element insertable into a selected one of the main body portion and the detachable body portion to vary the voice scripts available to be played.

8. The toy assembly of claim 2, wherein each brain-shaped block is formed of a translucent, resilient material.

9. The toy assembly of claim 1, wherein the first main body portion further comprises a first accessory associated with the first archetype; and wherein the second main body portion further comprises a second accessory associated with the second archetype.

10. The toy assembly of claim 9, wherein the first accessory comprises a baby bottle; and wherein the second accessory comprises a firearm.

11. The toy assembly of claim 1, wherein the first voice script is stored in the first detachable body portion; and wherein the second voice script is stored in the second detachable body portion.

12. The toy assembly of claim 1, wherein each of the first and second main body portions further comprises a respective light source.

13. The toy assembly of claim 12, wherein the light source comprises a light emitting diode.

14. The toy assembly of claim 12, wherein each of the first and second main body portions further comprises a respective set of eyes, wherein each light source is configured to illuminate the corresponding set of eyes.

15. The toy assembly of claim 1, wherein the first detachable body portion comprises a first type identifier, wherein the first type identifier corresponds with the first archetype; and wherein the second detachable body portion comprises a second type identifier, wherein the second type identifier corresponds with the second archetype.

16. The toy assembly of claim 15, wherein each of the first and second type identifier comprises a respective projecting pin.

17. The toy assembly of claim 15, wherein the first voice script is stored within the first main body portion; and wherein the second voice script is stored within the second main body portion.

18. The toy assembly of claim 1, wherein the structure of the first main body portion is substantially different from the structure of the second main body portion, such that the appearance of the first main body portion is substantially different from the appearance of the second main body portion.

19. A toy, comprising:

(a) a body having a first archetype personality, wherein the body has a head;

(b) a first head portion associated with the first archetype, wherein the first head portion is formed as a detachable part of the head, wherein the first head portion is configured to engage with the head of the body;

(c) a second head portion associated with a second archetype personality, wherein the second head portion is formed as a detachable part of the head, wherein the second head portion is configured to engage with the head of the body, wherein the structure of the second head portion is substantially similar to the structure of the first head portion such that the appearance of the second head portion is substantially similar to the appearance of the first head portion; and (d) voice circuitry responsive to the first head portion being attached to the head of the body to access and play an audio sample associated with the first archetype personality; wherein the voice circuitry is further responsive to the second head portion being attached to the head of the body to access and play another audio sample associated with the second archetype personality; wherein each audio sample comprises a voice script associated with a selected archetype personality by word content and by a tonal quality, the voice circuitry further configured to respond to the second head portion by playing a voice script having a word content associated with the second archetype personality with a tonal quality associated with the first archetype personality.

* * * * *